US011215415B2

(12) United States Patent
Delgado Acarreta et al.

(10) Patent No.: US 11,215,415 B2
(45) Date of Patent: Jan. 4, 2022

(54) SAFETY DEVICES FOR FIRING WEAPONS

(71) Applicant: RADE TECNOLOGIAS, S.L., Saragossa (ES)

(72) Inventors: Raúl Delgado Acarreta, Saragossa (ES); Daniel Osuna Sanz, Saragossa (ES); Alejandro Gállego Torrijos, Saragossa (ES)

(73) Assignee: RADE TECNOLOGIAS, S.L., Saragossa (ES)

( * ) Notice: Subject to any disclaimer, the term of this patent is extended or adjusted under 35 U.S.C. 154(b) by 0 days.

(21) Appl. No.: 16/950,965

(22) Filed: Nov. 18, 2020

(65) Prior Publication Data

US 2021/0148665 A1 May 20, 2021

(30) Foreign Application Priority Data

Nov. 18, 2019 (EP) ..... 19383015

(51) Int. Cl.
*F41A 17/06* (2006.01)
*F41A 19/10* (2006.01)

(52) U.S. Cl.
CPC ..... *F41A 17/06* (2013.01); *F41A 19/10* (2013.01)

(58) Field of Classification Search
CPC ..... F41A 17/06; F41A 17/00; F41A 17/22; F41A 17/46; F41A 19/00; F41A 19/10
See application file for complete search history.

(56) References Cited

U.S. PATENT DOCUMENTS 4,135,320 A * 1/1979 Smith ..... F41A 17/74 42/70.01
4,970,819 A * 11/1990 Mayhak ..... F41A 17/066 42/70.01
5,016,376 A * 5/1991 Pugh ..... F41A 17/063 42/70.06
5,758,524 A * 6/1998 Yu ..... E05B 47/0038 292/251.5
6,802,305 B1 * 10/2004 Hatcher ..... F41A 19/10 124/31
8,677,665 B1 * 3/2014 Huber ..... F41A 17/56 42/70.04

(Continued)

FOREIGN PATENT DOCUMENTS

EP 0125705 A2 11/1984
EP 0125705 A3 11/1984
EP 2252852 B1 9/2014

OTHER PUBLICATIONS

European Search Report of EP No. 19383015.5 dated May 27, 2020.

*Primary Examiner* — Joshua E Freeman
(74) *Attorney, Agent, or Firm* — Don D. Cha; HDC Intellectual Property Law, LLP

(57) ABSTRACT

A trigger (100) for a weapon, the weapon comprising a sear disconnected from the trigger, the trigger (100) comprises a lever (110) mechanically coupled by one end to the trigger (100), the lever (110) comprising a contact surface (110*a*) that causes rotation of the sear, a carrier (120), an actuator (130) that actuates the carrier (120), a first magnetic element (140) established on the lever (110) and a second magnetic element (142) established on the carrier (120), wherein at least the first magnetic element (140) or the second magnetic element (142) is a magnet or an electromagnet, wherein the trigger (100) comprises a firing state and a safe state.

19 Claims, 7 Drawing Sheets

(56) References Cited

U.S. PATENT DOCUMENTS

| | | | | |
|---|---|---|---|---|
| 9,541,341 | B2 * | 1/2017 | Macy | F41A 19/16 |
| 10,228,208 | B2 * | 3/2019 | Galie | F41A 19/59 |
| 2002/0021206 | A1 * | 2/2002 | Wootton | F41A 17/063 340/5.61 |
| 2003/0221684 | A1 * | 12/2003 | Rice | F41A 19/10 124/71 |
| 2015/0377574 | A1 * | 12/2015 | Cooke | F41A 17/56 42/70.11 |

* cited by examiner

SAFETY DEVICES FOR FIRING WEAPONS

CROSS-REFERENCE TO RELATED APPLICATIONS

This application is a 35 U.S.C. § 371 U.S. National Stage Application of EP Patent Application No. 19383015.5, filed Nov. 18, 2019, which is incorporated herein by reference in its entirety.

OBJECT OF THE INVENTION

The present invention refers to safety devices for firing weapons.

Particularly, the object of the present invention is to provide a safety trigger and safety device for a firing weapon as well as a method for selecting between a firing state and a safe state using the proposed safety trigger according to the present invention.

BACKGROUND OF THE INVENTION

Conventional safety mechanisms for firing weapons either in automatic mode or semi-automatic mode do not allow remote control as they consist in mechanical devices that require the user to manually actuate them. Furthermore, the force required to perform transition of the weapon from a firing state to a safe state and vice versa may be considerably high as well as the wear suffered by the mechanical parts of the safety mechanisms. In contrast, the speed transition from firing state to a safe state and vice versa tend to be slow as it fully depends on the mechanical response of the conventional safety mechanism.

Hence, a solution for at least the mentioned drawbacks given by the conventional safety mechanisms for firing weapons is desired.

Description of the Invention

The present invention relates to an electromechanical safety for weapons. In the context of the present description, by weapon it is meant any small arm or light weapon, such as a firearm, gun, shotgun, air gun, machine gun, pistol, rifle, revolver, etc. and non-lethal weapon or archery weapon as well.

The electromechanical safety device for weapons comprises a safety trigger wherein a transition from a firing state to a safe state is made by disconnection of the kinematic shooting chain by means of magnetic elements e.g. ferromagnets, in particular magnets. For this purpose, a conventional trigger is modified to perform its original function (firing state) or not (safe state) in both semiautomatic and automatic mode.

Conventionally, in the semiautomatic mode, the sear retains the hammer of the weapon. As there is interaction between the trigger and the sear, by pulling the trigger, the sear releases the hammer, allowing a shot to be fired. In the automatic mode, even being an actuator the element that holds the hammer, the trigger and the sear must interact. Shooting occurs until the trigger is released. In this moment, the sear retains the hammer and does not release it until the trigger is pulled again.

Therefore, by controlling the interaction between the trigger and the sear, it is possible to control the safe or firing state or position of the weapon in addition to and independent of the original weapon safeties.

Hence, in one aspect of the present invention it is proposed a safety trigger for a weapon, the weapon comprising a sear disconnected from the trigger, the trigger comprises a lever mechanically coupled by one end to the trigger, the lever comprises a contact surface that causes rotation of the sear, a carrier, an actuator that actuates the carrier, a first magnetic element established on the lever and a second magnetic element established on the carrier. In this regard, the first magnetic element or the second magnetic element is a magnet or an electromagnet.

Hence, the trigger comprises a firing state, wherein the actuator actuates the carrier such that the first magnetic element and the second magnetic element attract each other, and wherein the attraction between the first magnetic element and the second magnetic element causes the connection of the trigger and the sear through the contact surface of the lever allowing a shot to be fired when pulling the trigger.

The trigger also comprises a safe state, wherein the actuator actuates the carrier such that the first magnetic element and the second magnetic element do not attract each other, and wherein the lack of attraction between the first magnetic element and the second magnetic element avoids the connection of the trigger and the sear impeding a shot to be fired when pulling the trigger.

In some examples, the trigger further comprises means for identifying the state of the trigger. In some examples, the means comprises one or more third magnetic elements established on the carrier, preferably magnets or electromagnets.

In some examples, the means for identifying the state of the trigger comprises a magnetic field sensor, preferably a hall sensor associated with the one or more third magnetic elements. In some examples, the means for identifying the state of the trigger comprises a stepper motor, a mechanical switch or mechanical stoppers. In some examples, the actuator is a motor or an electromagnet.

Another aspect of the present invention relates to the use of the trigger according to the first aspect of the present invention for firing a weapon in an automatic mode and the use of the trigger for firing a weapon in a semi-automatic mode.

Another aspect of the present invention relates to a safety device for a weapon, the device comprising the trigger according to first aspect of the present invention, electronics comprising selection means for performing selection between the firing state and the safe state of the trigger, a processing unit to control the actuator based on said selection and a battery.

In some examples, the electronics further comprise light indicators, preferably a safety status indicator, a communication indicator and an error or warning indicator. In some examples, the selection means comprises an actuator switch.

In some examples, the selection means comprises a sensor circuit, and the device further comprises a remote controller in wireless communication with the sensor circuit, wherein the sensor circuit is configured to receive a first signal from the remote controller that indicates a selection between the firing state and the safe state of the trigger. In some examples, the safety device also comprises a transmitting bracelet or token in wireless communication with the sensor circuit, wherein the sensor circuit is configured to receive a second signal from the remote controller that indicates a selection between the firing state and the safe state of the trigger. In this regard, the processing unit is configured to control the actuator based on said first signal and/or said second signal.

In some examples, the selection means comprises a receiving device, wherein the pointing of the weapon at an external emitter device in communication with the receiving device causes the receiving device to receive a third signal from the external emitter device that indicates a selection between the firing state and the safe state of the trigger, and the processing unit is configured to control the actuator based on said third signal.

Another aspect of the present invention relates to a weapon comprising the safety device or the trigger according to the first aspect of the present invention.

A final aspect of the present invention relates to a method for selecting between a firing state or a safe state of a trigger for a weapon, the weapon comprising a sear disconnected from the trigger.

The method comprises a first step for selecting the firing state of the trigger, the trigger comprising a lever mechanically coupled by one end to the trigger, the lever comprising a contact surface that causes rotation of the sear, a carrier, an actuator that actuates the carrier, a first magnetic element established on the lever and a second magnetic element established on the carrier. Wherein at least the first magnetic element or the second magnetic element is a magnet or an electromagnet and wherein in the firing state, the actuator actuates the carrier such that the first magnetic element and the second magnetic element attract each other, and wherein the attraction between the first magnetic element and the second magnetic element causes the connection of the trigger and the sear through the contact surface of the lever allowing a shot to be fired when pulling the trigger.

The method further comprises a second step for selecting the safe state of the trigger, wherein in the safe state the actuator actuates the carrier such that the first magnetic element and the second magnetic element do not attract each other, wherein the lack of attraction of the first magnetic element and the second magnetic element avoids the connection of the trigger and the sear impeding a shot to be fired when pulling the trigger.

BRIEF DESCRIPTION OF THE DRAWINGS

For a better understanding the above explanation and for the sole purpose of providing an example, some non-limiting drawings are included that schematically depict a practical embodiment.

DESCRIPTION OF A PREFERRED EMBODIMENT

Figure 1:
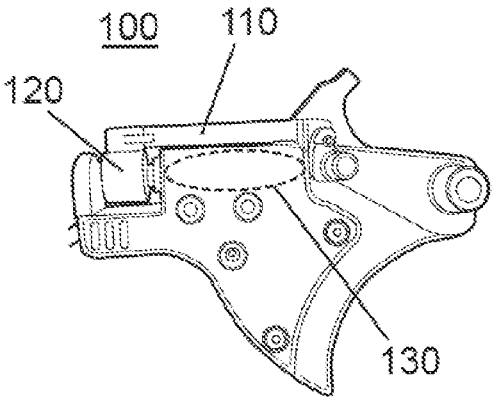
FIG. 1 shows the main elements of the proposed trigger according to the present invention.

FIG. 1 shows the main elements of a proposed safety trigger (100) according to the present invention. A conventional trigger interacts with the sear by means of a contact surface that causes the rotation of the sear when the trigger is pulled. Hence a conventional trigger is modified to achieve the object of the present invention and thus develop the proposed new trigger (100) as shown in FIG. 1 with an integrated safety mechanism that enables the trigger in two states: a firing state or a safe state.

Figure 2:
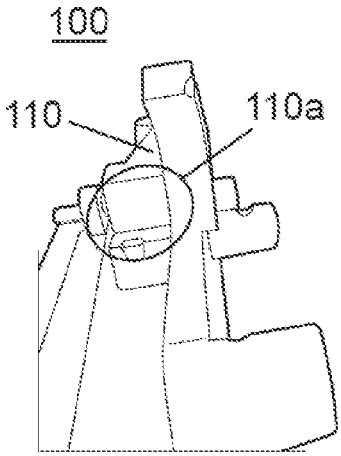
FIG. 2 shows a contact surface of the safety lever which interacts with the sear of the weapon.

As shown in FIGS. 1 to 3, the proposed trigger (100) comprises a safety lever (110) (with the contact surface (110*a*) of the conventional trigger at one end and a magnet (140) at the other) and a carrier, e.g. a cam (120) or a cylinder with a magnetic element e.g. an attraction magnet (142) to a magnetic element as e.g. a magnet (140) located in the safety lever. The cam (120) is actuated by a motor (130) integrated as part of the trigger (100).

Optionally, there may be one or more additional magnets (142*a*, 142*b*) to know the safe or firing state of the safety mechanism as shows in FIGS. 9 to 12. Moreover, there are other alternative ways to know the position of the safety mechanism, such as through a stepper motor, mechanical stoppers, and so on.

In this regard, the contact surface (110*a*) as shown in FIG. 2 as in the conventional trigger is maintained to make the proposed trigger (100) to interact (move together) with the sear of the weapon (not shown in the figure) when the trigger (100) is in the firing state.

Contrarily, when the trigger is in the safe state, the movement of the trigger (100) does not produce movement in the sear since they are disconnected, there is no contact between the proposed trigger (100) and the sear. Hence, the trigger (100) can be pulled in the safe state but this action does not move the sear. Thanks to the fact that the trigger is disconnected (through the safety lever (110)) from the sear, it can be possible to move the trigger to the safe state even when the user of the weapon has begun to pull the trigger (100). This is very useful in the application to shooting galleries for training purposes to prevent unexperienced users from having accidents or to avoid misuse.

By placing the magnet (140) at one end of the safety lever (110) (or at least, at farthest from the lever axis as possible), as the distance of the magnet (140) to the axis is much bigger than the distance of the contact surface to the axis, the force to be applied is much smaller, which reduces the size of the magnets to be used (hence, reducing cost and easing integration inside the weapon). This also permits using a actuator/motor (130) (necessary to place the cam (120) in its different positions) of lower force (torque) and therefore (in a motor speed and torque are inversely proportional), the motor speed can be increased by achieving greater speed in transition from firing state to safe state and vice versa.

Furthermore, the wear suffered by mechanical parts that come into contact to move from one state to another is reduced.

Furthermore, the magnetic interaction acts much faster than a hydraulic-pneumatic interaction. In addition, only a motor rotation is needed to move from one state to another, so it is faster than a mechanical translation of an element moving through a motor.

Advantageously, the safe or firing state is maintained by itself, thanks to the magnets (140, 142). For example, if an electromagnet would be used, a constant voltage would be needed. Alternatively, using only a motor to overcome the inertia of the rotor shaft may be possible.

Additionally, the dimensioning of the motor (130) (torque and speed) is independent from the mechanisms of the weapon (kinematic chain). It only depends on the attraction force of the magnets (140, 142). Advantageously, to provide a safety trigger in the space occupied by a conventional trigger, prevents occupying space from the weapon that can be occupied to house other elements.

Figure 3A:
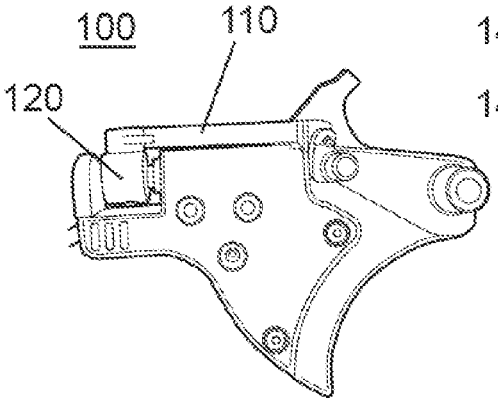
FIGS. 3A and 3B show the firing and the safe state of the proposed trigger according to the present invention.

FIG. 3A shows the trigger (100) in firing state: The motor (130) actuates the cam (120) such that the magnet (140) and the magnet (142) attract each other and wherein the attraction between the magnets (140, 142) causes the connection of the trigger (100) and the sear through the contact surface (110*a*) of the lever (110) allowing a shot to be fired when pulling the trigger (100). Hence, the trigger (100) via the safety lever (110), and the sear interact, i.e. they are mechanically linked. Hence, when the trigger (100) is pulled, the safety lever (110) interacts with the sear, allowing a shot to be fired in both, semi-automatic and automatic mode.

Figure 3B:
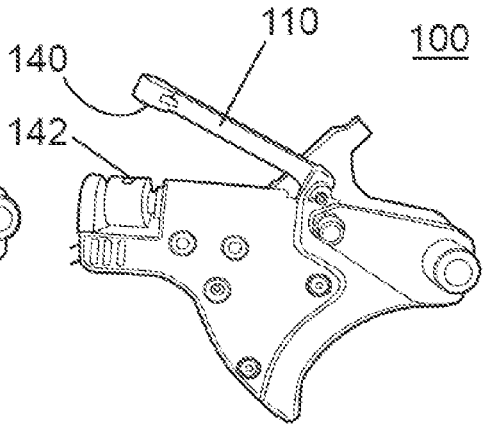

FIG. 3B shows the trigger (100) in the safe state wherein the safety lever and the sear do not interact (they are not mechanically linked). The motor (130) actuates the cam (120) such that the magnets (140, 142) do not attract each other. The lack of attraction between the magnets (140, 142) avoids the connection of the trigger (100) and the sear impeding a shot to be fired when pulling the trigger. Hence, when the trigger (110) is pulled, the safety lever (110) does not interact with the sear, impeding a shot to be fired in both, semi-automatic and automatic mode.

Figure 4:
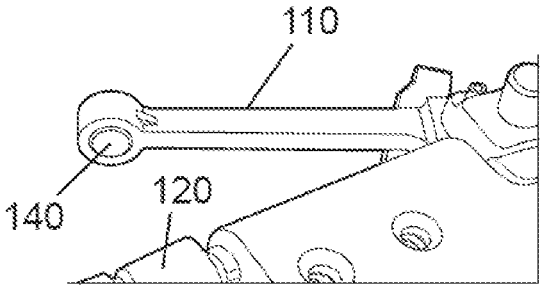
FIG. 4 shows a view of the safety lever magnet.

Some of the different possible configurations of magnets and the function of each of them are shown in the following figures:

As shown in FIG. 4, a magnet (140) is located at one end of the safety lever (110) and facing the cam (120): The position of the magnet (140) is not mandatory, it could be located in an intermediary position of the safety lever (110), as an example.

Figure 5:
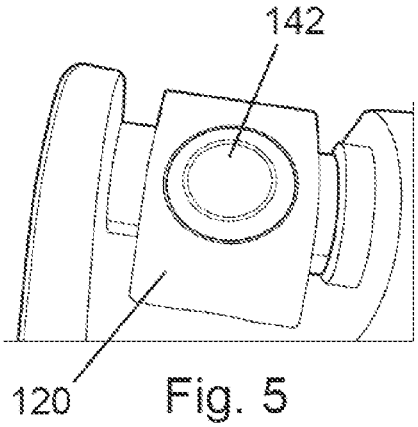
FIG. 5 shows a view of the attraction magnet to that of the safety lever.

As shown in FIG. 5, one attraction magnet (142) is located in the cam (120), so that it is facing (in the case of one) the magnet (140) of the safety lever (110) shown in FIG. 4 or in another position, depending on whether the weapon is placed in firing or safe state.

Figure 6:
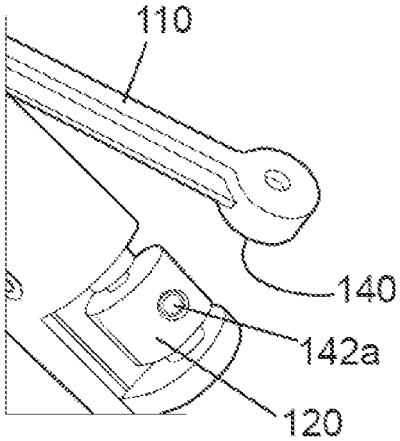
FIG. 6 shows a view of the repulsion magnet to that of the safety lever.

In another example, as shown in FIG. 6, the cam (120) further comprises more magnets, in particular an optional repulsion magnet (142*a*) to that of the magnet (140) of the safety lever (110). This repulsion magnet (142*a*) has two functions, none of them indispensable/essential:

To ensure the safe state is maintained.

To know in what position/state the trigger is: safe or firing state. In this regard, a magnetically sensitive sensor device e.g. a Hall sensor (150) is placed in a PCB (Printed Circuit Board) (150*a*) integrated in the trigger (100) so that the safe or firing position/state of the weapon is known.

This Hall sensor (150) can also have another application or even another sensor can be used for this purpose. As an example, if someone, knowing that the disconnection of the kinematic shooting chain of the proposed trigger (100) is made by means of magnetic elements, wants to cause a malfunction of said trigger (100) and brings a magnet closer to our safety device, this external magnetic field that can interfere with the operation of our safety device can be detected and place the weapon comprising the proposed trigger (100) in a safe state.

Furthermore, the hall sensor (150) allows to know the position of the weapon safety and to warn to the user of the weapon in case of mechanical failure of the safety device. As an example, if the motor-cam set fails (not turning enough, battery failure, and so on), the sensor reading anticipates and sends a failure alert to the weapon user.

Hence, the combination of these two elements, the hall sensor (150) and the repulsion magnet (142*a*) generates a switch that transcribes the position changes of the element to be monitored (in this case the cam (120)) to the rest of the device.

In the particular embodiments as shown in the following figures in which there are several magnets in the cam (120), the position/configuration of these can be very different, they can be at 180° or in any other position, there can be e.g. a third magnet (speed magnet) to reduce the travel (time) from firing state to safe state and vice versa.

Figure 11:
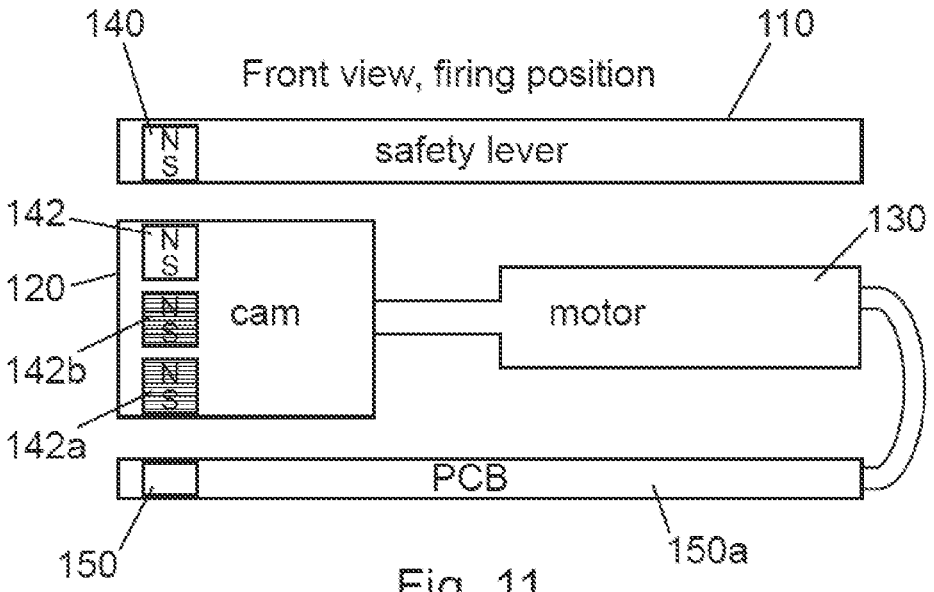
FIG. 11 shows a front view in the embodiment with three magnets in the cam and the safety device in firing state.
Figure 12:
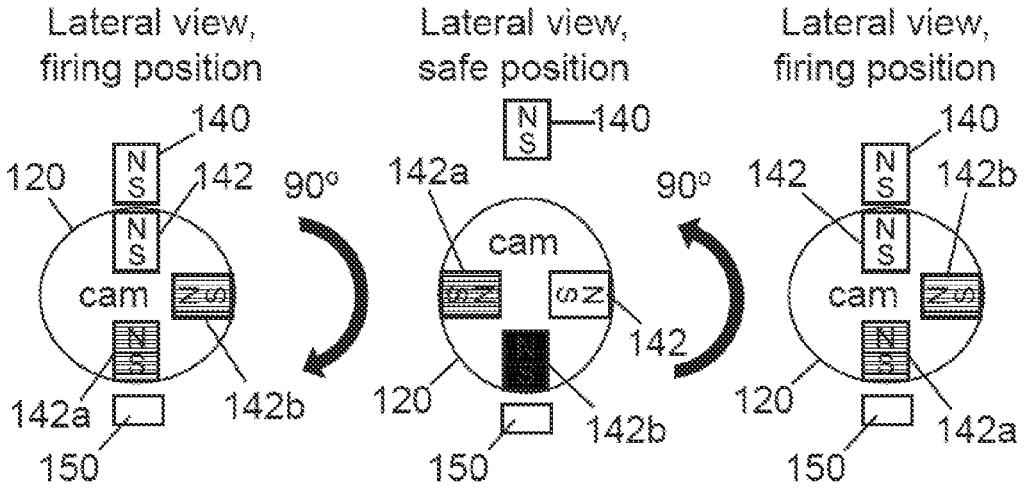
FIG. 12 shows a lateral view in the embodiment with three magnets in the cam and the transition from firing state to safe state and vice versa.

In fact, another option is currently being implemented with three magnets as shown in FIGS. 11 and 12 to increase the speed of transition to firing state and safe state, as explained below. The lower the rotation of the motor (130) to move from one state to another is, the faster the movement from one state to another is, and the faster the indication to the user of the weapon is given. Therefore, accidents are reduced.

In the following figures different possible configurations are shown as preferred embodiments (the required magnets are represented: the magnet (140) of the safety lever (110) and one of the attraction magnet (142) of the cam (120)). The rest of the optional magnets (142*a*, 142*b*) and the hall sensor (150) are used to know in which position the trigger (100) is (not to make the transition/movement from safe state to firing state or vice versa).

Figure 7:
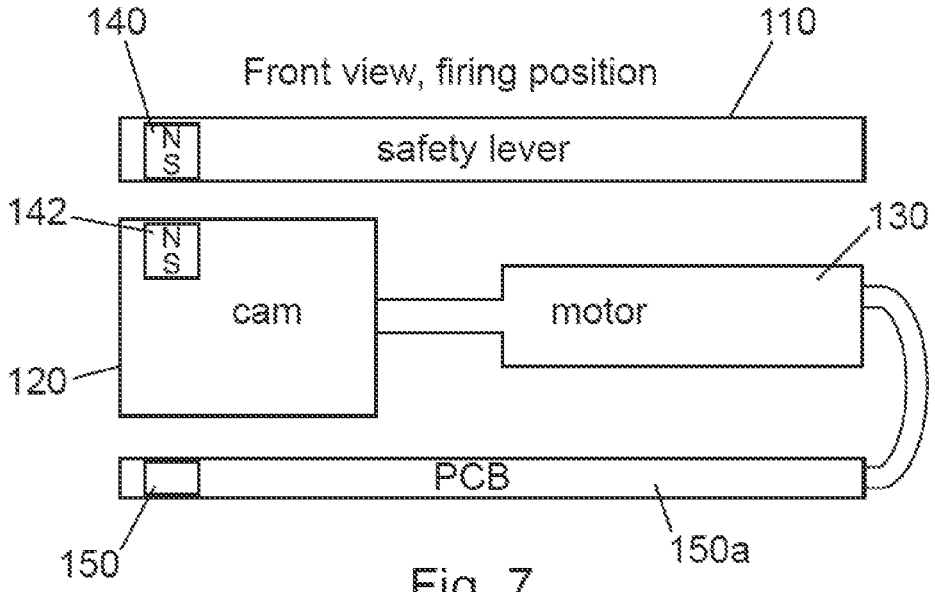
FIG. 7 shows a front view in the embodiment with one magnet in the cam and the safety device in firing state

Hence, FIG. 7 shows a front view in an example with one magnet in the cam (120) and the safety device when the trigger (100) is in the firing state. It is shown the magnet (140) in the safety lever (110) contacting the attraction magnet (142) located in the cam (120). The cam (120) is actuated by the motor (130) which at the same time is connected to a PCB (150*a*) wherein the Hall sensor (150) is established.

Figure 8:
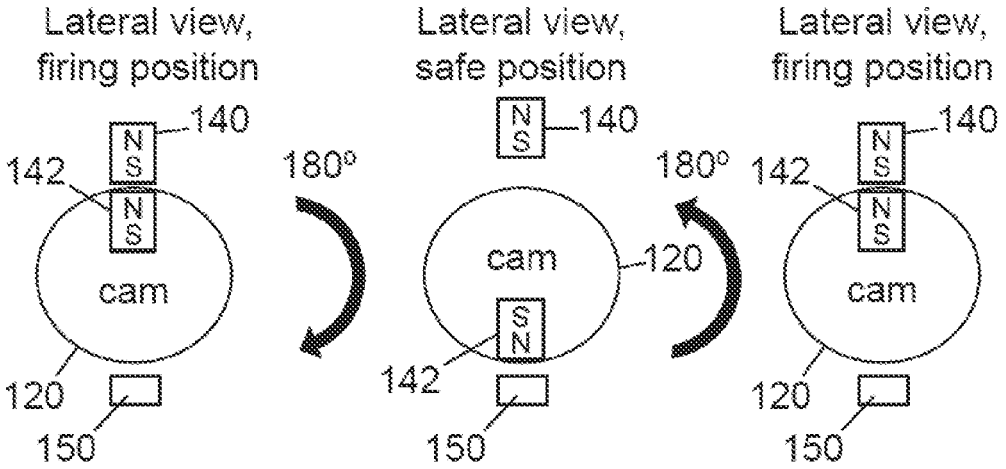
FIG. 8 shows a lateral view in the embodiment with one magnet in the cam and the transition from firing state to safe state and vice versa

FIG. 8 shows the transition from firing state to safe state of the trigger (100) and vice versa upon the motor (130) actuating the cam (120) 180° that carries the attraction magnet (142). It can be appreciated the magnet (140) interacting with the attraction magnet (142) established in the cam (120) in the firing state and at the same time the attraction magnet (142) interacting with the hall sensor (150) in the safe state.

Figure 9:
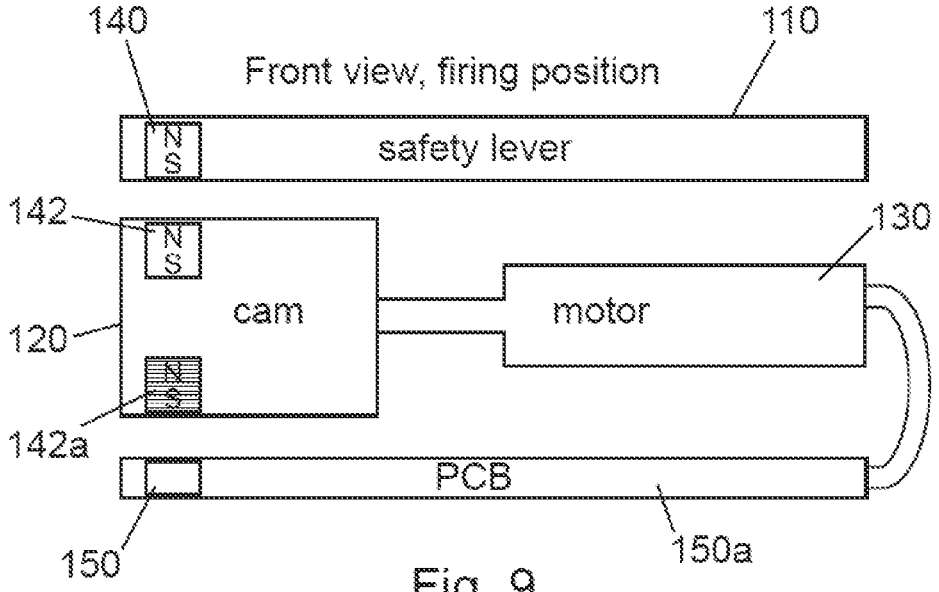
FIG. 9 shows a front view in the embodiment with two magnets in the cam and the safety device in firing state.
Figure 10:
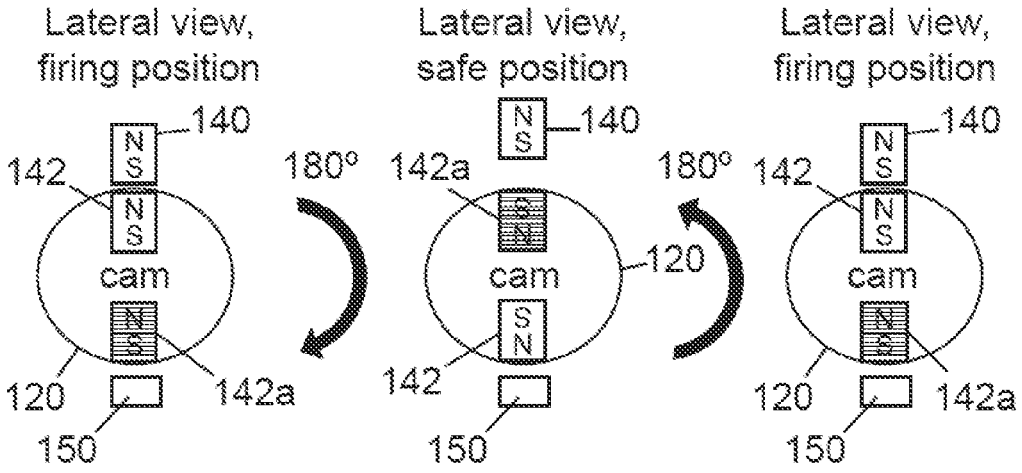
FIG. 10 shows a lateral view in the embodiment with two magnets in the cam and the transition from firing state to safe state and vice versa.

FIG. 9 shows a further example of a trigger (100) having a second magnet comprised in the cam (120), i.e. the repulsion magnet (142*a*) adapted to repulse the magnet (140). It is shown in FIG. 10 how the repulsion magnet (142*a*) repulses the magnet (140) in the safe state upon the motor (130) actuating the cam (120) 180° and carrying the attraction magnet (142) and the repulsion magnet (142*a*).

In another example, FIG. 11 shows a further example of a trigger (100) having a third magnet comprised in the cam (120), i.e. a speed magnet (142*b*). The main advantage of this configuration is that it increases the speed of transition to firing state and to safe state. With this configuration, the needed rotation of the cam (120) to move from one state to another is reduced from 180° to 90°, thus reducing the time from when the order is given until it happens. It is shown in FIG. 12 the different configurations upon the motor (130) actuating the cam (120) 90° and carrying the attraction magnet (142), the repulsion magnet (142*a*), and the speed magnet (142*b*). In this example the repulsion magnet (142*a*) can be optional as the speed magnet (142*b*) can be also configured as a repulsion magnet.

In any of the different configurations of the magnets, the rotation of the cam is controlled through the motor (130) integrated in the trigger (100) (In other examples, instead of a motor, it could be an electromagnet or other similar element).

Figure 13:
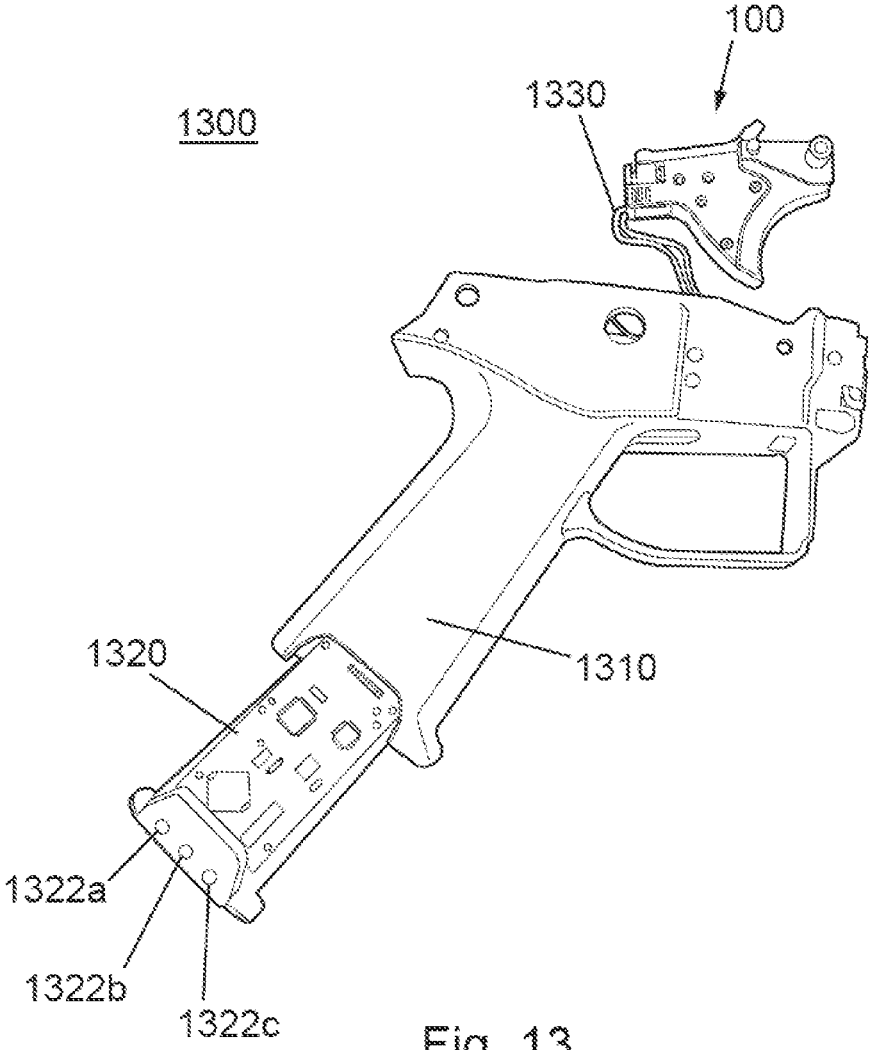
FIG. 13 shows an exploded view with the safety device comprising the trigger and a pistol grip.

FIG. 13 shows a safety device (1300) according to the present invention suitable for a weapon. In the safety device (1300), the motor (130) is powered by a power supply (such as a battery) housed in a pistol grip (1310) of a weapon, where the rest of the control electronics (1320) are housed. The electronics (1320) can comprise a sensor device, selection means for performing selection between the firing state and the safe state of the trigger and a processing unit to control the actuator (130) of the trigger (100) based on said selection. The safety device (1300) can comprise a battery.

In other examples, the battery and any other electronic components can be in other areas of the weapon, such as the buttstock, the picatinny rail and so on. There may even be several power supplies/batteries in different zones (for example, to act as backup, that it is to say: the main battery runs out of energy so the safety device cannot change its firing or safe state). With the additional battery, it is possible to change the position of the safety device, reducing the risk of an accidental shot.

Furthermore, FIG. 13 also shows the proposed trigger (100) as part of the safety device (1300) connected by wiring means (1330) and as part of the electronics (1320) of the safety device (1300): a safety status indicator (1322*a*), a communication status indicator (1322*b*), and error warning indicator (1322*c*).

The safety status indicator (LED) (1322*a*): it can light in green if the safety device is in safe state or red if the safety device is in firing state.

The communication status indicator (LED) (1322*b*): it can light in blue if the weapon is linked to the controller (if the weapon is controlled by a controlling user). This indicator is off if the weapon is not linked to any controller.

The error or warning indicator (LED) (1322*c*): it can light in red if there is an error/failure in the safety device position (the user has given an order to move to the safe state, but it is detected with the hall sensor that said state has not be reached). This can happen, for example, due to motor failure, and so on. It can light in orange if there is low battery/warning signal. Although indicators are only seen on one side, they can be duplicated on the other side of the weapon (symmetrical to the axis of the weapon) so that indication is visible for ambidextrous.

The advantages of using a magnetic safety provides that the force to perform the transition of the weapon from the firing state to the safe state is reduced. The force to separate two magnets e.g. (140, 142) with opposite poles facing each other is maximum in the axis perpendicular to them. Therefore, if it is intended to separate both with a movement in that axis, the force required must be very large, which means having to use a motor and a battery of large dimensions. When making the force to separate both magnets (140, 142) in a direction perpendicular to the axis between them, the force needed to separate them is much lower. Therefore, the motor and the battery needed can be of reduced dimensions and it allows us to house it in the interior of the weapon. In addition, as force (torque) and speed in a given motor are inversely proportional, the lower the force, the greater the speed, which translates into faster transition from one position of the safety device to another, avoiding accidents, and so on.

Electronic devices mentioned in the previous paragraph can be diverse, depending on how the weapon is being controlled:

By a controlling user other than the weapon user. For example, the controlling user has a remote controller (or even a mobile phone) that communicates wirelessly via RF with the electronics embedded in the safety device (1300) that comprise a sensor circuit. The remote controller sends the order to change to safe state or firing state to the safety device (1300) embedded in the weapon and it acts on the safety device (1300) to place it in the corresponding position.

By another transmitting device (for example, located in a bracelet or token that carries the user of the weapon) that communicates by capacitive coupling (or by NFC, and so on) with the safety device (1300) embedded in the weapon. In this way, the weapon only moves from safe state to firing state when the user of the weapon carries the bracelet. Advantageously, this implementation prevents the weapon from being used against the authorized user.

In another example, the safety device (1300) can be associated with an emitter located in a region surrounding a target and a receiving device located in the safety device (1300), so that a weapon can only be fired when pointing at the target area. Advantageously, this is important in shooting galleries, for training purposes to prevent unexperienced users from having accidents or to avoid misuse (e.g. a shooter shooting at the target of the other lanes).

Figure 14:
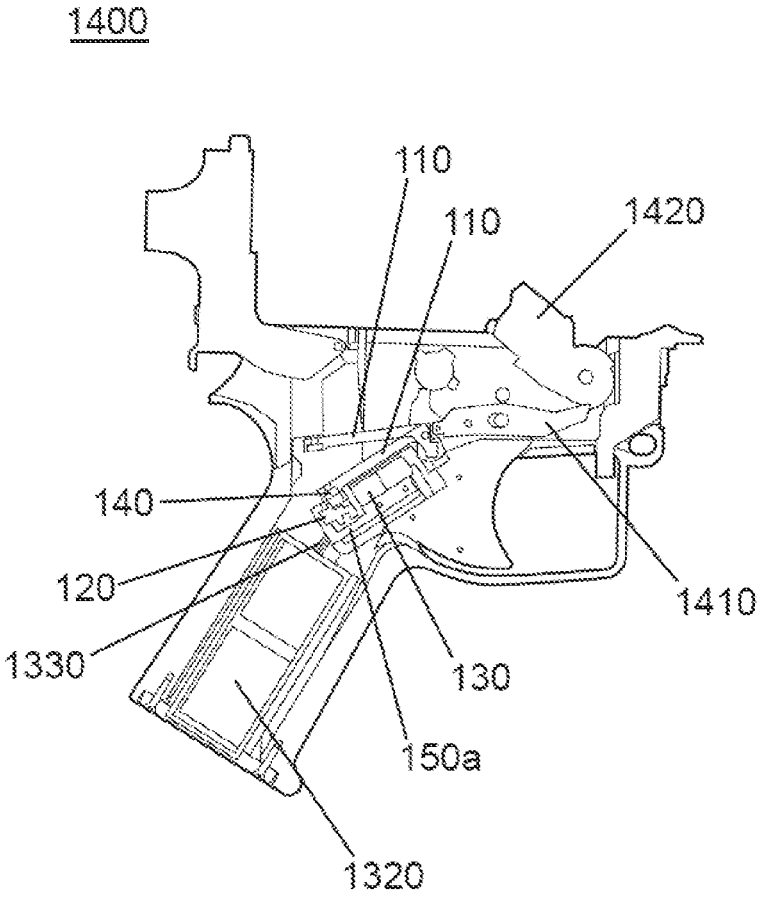
FIG. 14 shows an exploded view of a weapon comprising the safety device according to the present invention.

FIG. 14 shows the weapon (1400) comprising the safety device (1300) according to the present invention that includes the trigger (100). In particular, in FIG. 14 is shown the trigger (100) comprising the safety lever (110), the magnet (140), as well as the cam (120) that can carry the magnet (142) and additional magnets, i.e. repulsion magnet (142*a*) and speed magnet (142*b*) and the hall sensor (150). It is also shown the electronics (1320) housed in the pistol grip. Figure also shows as part of the weapon (1400) the hammer (1420) and the sear (1410).

Even though reference has been made to a specific embodiment of the invention, it is obvious for a person skilled in the art that the safety devices described herein are susceptible to numerous variations and modifications, and that all the details mentioned can be substituted for other technically equivalent ones without departing from the scope of protection defined by the attached claims.

The invention claimed is:

1. A trigger (100) for a weapon comprising a sear disconnected from the trigger, wherein the trigger (100) comprises:

a) a lever (110) mechanically coupled by one end to the trigger (100), the lever (110) comprising a contact surface (110*a*) that causes rotation of the sear;

b) a carrier (120);

c) an actuator (130) that actuates the carrier (120);

d) a first magnetic element (140) established on the lever (110); and e) a second magnetic element (142) established on the carrier (120), wherein at least one of the first magnetic element (140) or the second magnetic element (142) is a magnet or an electromagnet, and wherein when the trigger (100) is in a firing state, the actuator (130) actuates the carrier (120) such that the first magnetic element (140) and the second magnetic element (142) attract each other, wherein the attraction between the first magnetic element (140) and the second magnetic element (142) causes the connection of the trigger (100) and the sear through the contact surface (110*a*) of the lever (110) allowing a shot to be fired when pulling the trigger; and when the trigger (100) is in a safe state, the actuator (130) actuates the carrier (120) such that the first magnetic element (140) and the second magnetic element (142) do not attract each other, wherein the lack of attraction between the first magnetic element (140) and the second magnetic element (142) avoids the connection of the trigger (100) and the sear impeding a shot to be fired when pulling the trigger.

2. The trigger (100) according to claim 1 further comprising means for identifying the state of the trigger.

3. The trigger (100) according to claim 2, wherein the means for identifying the state of the trigger comprises one or more third magnetic elements (142*a*, 142*b*) established on the carrier (120).

4. The trigger (100) according to claim 3, wherein each of said one or more third magnetic elements (142*a*, 142*b*) is independently a magnet or an electromagnet.

5. The trigger (100) according to claim 3, wherein said means for identifying the state of the trigger (100) comprises a magnetic field sensor (150).

6. The trigger (100) according to claim 5, wherein said magnetic field sensor (150) is a hall sensor associated with the one or more third magnetic elements.

7. The trigger (100) according to claim 2, wherein said means for identifying the state of the trigger (100) comprises a stepper motor, a mechanical switch, or mechanical stoppers.

8. The trigger (100) according to claim 1, wherein the actuator (130) is a motor or an electromagnet.

9. The trigger (100) according to claim 1, wherein said trigger (100) is adapted for firing said weapon in an automatic mode.

10. The trigger (100) according to claim 1, wherein said trigger (100) is adapted for firing said weapon in a semi-automatic mode.

11. A safety device for a weapon, wherein said device comprises:

a trigger (100) according to claim 1;

an electronic device comprising a selection means for selecting between a firing state and a safe state of said trigger (100);

a processing unit to control the actuator (130) based on said selection; and a battery operatively connected to said electronic device.

12. The safety device according to claim 11, wherein said electronic device further comprises a light indicator.

13. The safety device according to claim 12, wherein said light indicator comprises a safety status indicator, a communication indicator, an error or warning indicator, or a combination thereof.

14. The safety device according to claim 11, wherein said selection means comprises an actuator (130) switch.

15. The safety device according to claim 11, wherein said selection means comprises a sensor circuit, and wherein said safety device further comprises:

a remote controller in wireless communication with said sensor circuit, wherein said sensor circuit is configured to receive a first signal from said remote controller that indicates a selection between a firing state and a safe state of said trigger;

a transmitting bracelet or token in wireless communication with said sensor circuit, wherein said sensor circuit is configured to receive a second signal from said remote controller that indicates a selection between a firing state and a safe state of the trigger; or a combination thereof, and wherein said processing unit is configured to control the actuator (130) based on said first signal, said second signal, or a combination thereof.

16. The safety device according to claim 11, wherein said selection means comprise:

a receiving device, wherein a pointing of the weapon at an external emitter device in communication with the receiving device causes the receiving device to receive a third signal from the external emitter device that indicates a selection between the firing state and the safe state of the trigger, and wherein the processing unit is configured to control the actuator (130) based on said third signal.

17. A method for selecting between a firing state or a safe state of a trigger (100) for a weapon comprising a sear disconnected from said trigger (100), wherein said trigger (100) comprises:

a) a lever (110) mechanically coupled by one end to the trigger, said lever (110) comprising a contact surface (110*a*) that causes rotation of the sear;

b) a carrier (120);

c) an actuator (130) that actuates the carrier (120);

d) a first magnetic element (140) established on the lever (110); and e) a second magnetic element (142) established on the carrier (120), wherein at least one of the first magnetic element (140) or the second magnetic element (142) is a magnet or an electromagnet, and wherein when said trigger (100) is in the firing state, the actuator (130) is adapted to actuate the carrier (120) such that the first magnetic element (140) and the second magnetic element (142) attract each other, whereby the attraction between the first magnetic element (140) and the second magnetic element (142) causes the connection of the trigger (100) and the sear through the contact surface (110*a*) of the lever (110) thereby allowing a shot to be fired when said trigger is pulled; and when said trigger (100) is in the safe state, the actuator (130) actuates the carrier (120) such that the first magnetic element (140) and the second magnetic element (142) do not attract each other, whereby the lack of attraction of the first magnetic element (140) and the second magnetic element (142) prevents the connection of the trigger (100) and the sear thereby preventing a shot to be fired when said trigger is pulled, said method comprising selecting the firing state of said trigger (100) or the safe state of said trigger (100).

18. A weapon comprising the safety device according to claim 11.

19. A weapon comprising the trigger (100) according to claim 1.

* * * * *